US005704846A

United States Patent [19]

Johnson

[11] Patent Number: 5,704,846

[45] Date of Patent: Jan. 6, 1998

[54] TRAINING DEVICE FOR GOLFERS

[76] Inventor: Charles T. Johnson, 1812 N. 79th Ter., Kansas City, Kans. 66112

[21] Appl. No.: 810,129

[22] Filed: Feb. 25, 1997

[51] Int. Cl.[6] ..... A63B 69/36

[52] U.S. Cl. ..... 473/214; 473/276; 473/268; 473/270; 128/782; 434/252; 273/DIG. 30

[58] Field of Search ..... 473/214, 276, 473/268, 270; 128/782; 434/252; 273/DIG. 30

[56] References Cited

U.S. PATENT DOCUMENTS

| | | | |
|---|---|---|---|
| 2,809,042 | 10/1957 | Wasley . | |
| 2,943,859 | 7/1960 | Koski et al. | 473/214 |
| 3,884,478 | 5/1975 | Buzan . | |
| 3,990,709 | 11/1976 | DeRogatis . | |
| 4,193,065 | 3/1980 | Bittner . | |
| 5,069,457 | 12/1991 | Korzenowski . | |
| 5,425,539 | 6/1995 | Steffes . | |
| 5,586,943 | 12/1996 | Clay | 473/214 |

*Primary Examiner*—George J. Marlo
*Attorney, Agent, or Firm*—Hovey, Williams, Timmons & Collins

[57] ABSTRACT

A golf club swing teaching aid is provided having an elongated inflatable tubular sleeve adapted to be worn by the golfer to restrain bending of the golfer's leading arm during backswing. An alarm assembly which emits an audible signal is mounted on the sleeve for alerting the golfer that his or her leading alarm has been allowed to bend to an undesirable extent during backswing of the golf club. Means is provided for adjustably mounting the alarm actuating components of the alarm assembly on the sleeve so that the golfer may select the degree of bending of his or her leading arm that may take place during backswing of a golf club before the audible alarm is sounded. Selective adjustment by the golfer of the degree of adjustment of the sleeve also has an effect on the timing of the audible alarm. The audible alarm is initiated upon normal bending of the leading arm during swing follow-through thus alerting the golfer to the fact that he or she can now allow their eyes to leave the ball impact zone and focus on the ball flight path. The sleeve has a non-inflated area at the arm crease which allows substantially unimpeded arm bending at the elbow during follow-through so that the golfer is not restrained from executing a normal technique throughout the swing.

19 Claims, 2 Drawing Sheets

TRAINING DEVICE FOR GOLFERS

BACKGROUND OF THE INVENTION

1. Field of the Invention

This invention relates to a golf club swing teaching aid, and particularly to the provision of an elongated tubular sleeve adapted to be worn by a golfer on his or her leading arm to restrain bending of the arm at the elbow during club backswing. If a golfer unduly bends his or her leading arm during backswing of the club, the primary effect is rotation of the club face away from the initial square position of the face at ball address. Thus, bringing the face back to the required square position is attainable only with great difficulty. Once the downswing of the club has been initiated, centrifugal force tends to keep the leading arm straight and therefore minimization of bending of the leading arm is most critical during the backswing. In particular, the teaching aid comprises an elongated inflatable tubular sleeve adapted to be worn by the golfer on his or her leading arm in disposition extending above and below the crease of the golfer's elbow.

An alarm assembly is provided on the sleeve which includes mechanism for emitting a signal discernable by the golfer indicative of bending of his or her arm to an undesirable extent during club backswing and downswing until the ball has been struck. The alarm assembly includes movable components whose relative positions are selectively adjustable by the golfer to infinitely vary the extent the golfer may bend his or her leading arm during backswing before the alarm signal is emitted.

The arm-bending restraint afforded by the inflatable sleeve is also infinitely variable by the golfer by changing the degree of inflation of the sleeve. Variation of the amount of inflation of the sleeve also has an affect on operation of the alarm actuating components. Accordingly, the golfer may precisely adjust the amount of bending of his or her leading arm that is permitted during backswing of a golf club swing before the alarm is actuated. The golfer is therefore encouraged to keep his or her leading arm straighter and straighter during backswing as his skill level progresses by successively making the alarm more and more sensitive to arm bending excursions during backswing of the club.

2. Description of the Prior Art

It is known to provide a tubular inflatable leading arm-stiffening device for use as a golf swing training aid. U.S. Pat. No. 2,943,859 to Koski et al. illustrates and describes an inflatable tubular sheath adapted to be placed on the golfer's leading arm in overlying relationship to the crease of his or her elbow. An air valve is provided for allowing air to be blown into the tubular sheath to inflate the arm-stiffening device. The advantage of the Koski et al. device is said to be said the ease with which it may be donned and taken off, and assertedy can be left on for a long time without causing reduced blood circulation in the wearer's arm. Koski et al. do not provide an alarm for alerting a golfer to the fact that his or her leading arm has been bent to an undesirable extent, or allow arm flexure during follow-through.

The Bittner U.S. Pat. No. 4,193,065 relates to a golf swing training device wherein an audible or visual alarm is provided indicating that the golfer has allowed his or her leading arm to bend to an undesirable extent. The electrically actuated alarm of the '065 patent has an elongated metal contact strip affixed to a member adapted to be secured to the golfer's arm above the elbow, and another electrical contact on a member adapted to be positioned on the golfer's arm below the elbow. When the golfer allows his leading arm to bend to a degree that the two contacts engage one another, a light bulb or audible buzzer, or both, are actuated. Bittner does not provide structure for selective variation of the extent of bending of the elbow that may take place before the alarm is activated.

In Buzan U.S. Pat. No. 3,884,478, the patentee discloses a flexible sleeve adapted to be placed over the golfer's leading arm in spanning relationship to his or her elbow. A magnet is provided on the lower end of the sleeve. An elongated arm member is pivotally affixed to the normally uppermost end of the sleeve and extends downwardly along the length thereof. This arm member has a piece of metal which normally engages and is held against the magnet when the golfer's arm is straight. However, when the golfer allows his or her arm to unduly bend, the metal member is forced away from the magnet, thus indicating that the golfer has bent his elbow. An audible sound is produced when the member affixed to the upper part of the sleeve shifts away from its magnetic support. No means is provided for adjusting the amount of bending of the golfer's arm that may take place before there is an indication of excessive arm bend.

Poggioli U.S. Pat. No. 3,419,276 describes and illustrates an arm-bend indicator for use by golfers wherein a two-piece device is connected across the elbow of the golfer's leading arm. Relative motion between the pieces allows bending of the elbow so that the golfer's normal swing will be neither confined or restricted. In response to relative motion caused by bending of the golfer's elbow an audible ball-and-socket sounding device announces to the golfer that his arm has bent at the elbow. This sounding device includes a ball audibly disengageable from a mating socket. There is no means for adjusting the point at which the ball-socket alarm actuated during bending of the golfer's arm.

Wasley U.S. Pat. No. 2,809,042 discloses a bent-arm audible signaling device for golfers comprising a strip of stiff, flexible spring material of concavo-convex configuration. When applied to a golfer's leading arm across his or her elbow, the device produces an audible signal much like a snap action toy "cricket" when the golfer has bent his her elbow to a point where the elongated, transversely curved member bends in the middle.

Degrogatis U.S. Pat. No. 3,990,709, Korzenowski U.S. Pat. No. 5,069,457, and Steffes U.S. Pat. No. 5,425,539 also show arm-stiffening devices for use by a golfer in order to restrain bending of his or her leading arm, but these devices do not incorporate alarms for alerting the golfer to the fact that there has been an undue bending of the leading arm at the elbow.

SUMMARY OF THE INVENTION

This invention concerns a golf club swing teaching aid which includes an elongated inflatable tubular sleeve adapted to be worn by a golfer on his or her leading arm to encourage the golfer to avoid bending the leading arm at the elbow during backswing of the club, thus assuring straighter balls upon downswing of the club. In particular, the teaching aid incorporates an alarm assembly on the tubular sleeve which emits a signal discernable by the golfer that his or her leading arm has been bent at the elbow to an undesirable degree during backswing. The alarm alerts the golfer to the fact that his or her leading arm has been allowed to bend to an undesirable extent during backswing and if not corrected will result in an errant ball hit. Thus, the golfer is sensitive to the fact that no alert should be heard during any part of the backswing; the audible alarm should be emitted and therefore heard only after ball impact in that it is proper procedure for the leading arm to be allowed to bend at the elbow during swing follow-through. During backswing and during follow-through, bending of the leading arm at the elbow will cause the alarm to be sounded but the alarm should be initiated and heard only during follow-through if the golfer has swung the club properly during backswing, downswing and follow-through. Once the golfer hears the alarm signal, only after the ball has been struck, he or she can then allow their eyes to shift from the impact zone to the ball flight path.

The alarm assembly includes telescopically interconnected first and second components and means adjustably mounting the components on the sleeve in a location such that one of the components extends above the golfer's elbow while the second component extends below the elbow crease. Electrically actuated mechanism is provided within the telescopically joined components which is operable to emit an audible arm when the two components are caused to move toward one another to a predetermined extent as a result of the golfer bending his or her arm at the elbow. The two telescopically interconnected components are adjustably secured to the sleeve so that the golfer may select the amount of bending of his or her elbow that may take place before the audible arm is generated. Furthermore, by virtue of the fact that the user of the teaching aid may selectively control the degree of inflation of the tubular sleeve around his or her arm, variation of the stiffness of the tubular sleeve also has an influence on the extent of telescoping of the alarm components carried by the sleeve, thus permitting control by the user of the amount of arm bending permitted before the alarm is actuated.

The foregoing is of importance in that the teaching aid may be selectively adjusted by the golfer as his or her skills improve with practice. For example, use of the teaching aid by a novice golfer might mandate adjustment of the alarm assembly to delay activation of the alarm even though some degree of arm bending is taking place during swinging of the golf club. However, as the golfer becomes more proficient and is able to swing the club with less and less undesirable bending of the leading arm at the elbow during backswing, the sensitivity of the alarm can be increased accordingly and proportionally to the golfer's improved swing development.

In addition, the elongated inflatable tubular sleeve of this invention desirably has a non-inflatable area that normally overlies the elbow crease of the golfer's leading arm which is of greater flexibility than the surrounding inflated portion of the sleeve thereby offering less resistance to bending of the elbow during follow-through. The telescopically joined alarm housing components are mounted on the tubular sleeve across the non-inflatable area thereof to assure accurate sensing of bending of the golfer's arm at the elbow, in that any bending of the elbow that occurs is not restrained by inflated portions of the sleeve that would otherwise overlie the elbow crease.

Infinite adjustment within limits of the relative positions of the alarm housing components is afforded by virtue of the fact that each of the housing components has a Velcro strip along the length thereof strategically positioned to engage a corresponding Velcro strip affixed to the body of the tubular sleeve adjacent the non-inflatable area of the sleeve. As a consequence, the user of the teaching aid may readily adjust the telescopic positions of the alarm housing components one with respect to another by simply pulling each housing component away from its Velcro fastener and then relocating the components in desired relative positions.

The alarm assembly of the telescopic aid desirably takes the form of electrically actuated mechanism including two separable contacts, each joined to a respective alarm housing component and connected to a power source and an audible alarm unit respectively, so that when the two components are shifted toward each other to a predetermined extent during bending of a golfer's elbow, the contacts are brought into interengagement, thus activating the alarm. This construction is simple in nature, substantially fool-proof, and provides infinite adjustability of alarm activation as previously indicated.

DETAILED DESCRIPTION OF THE PREFERRED EMBODIMENTS

Figure 1:
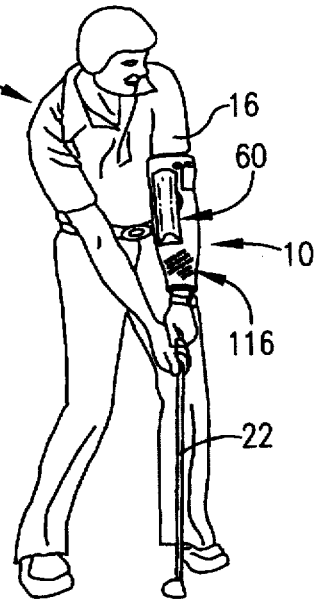
FIG. 1 is a pictorial view of a golfer with the improved golf club swing teaching aid of this invention in its normal position on his leading arm.
Figure 3:
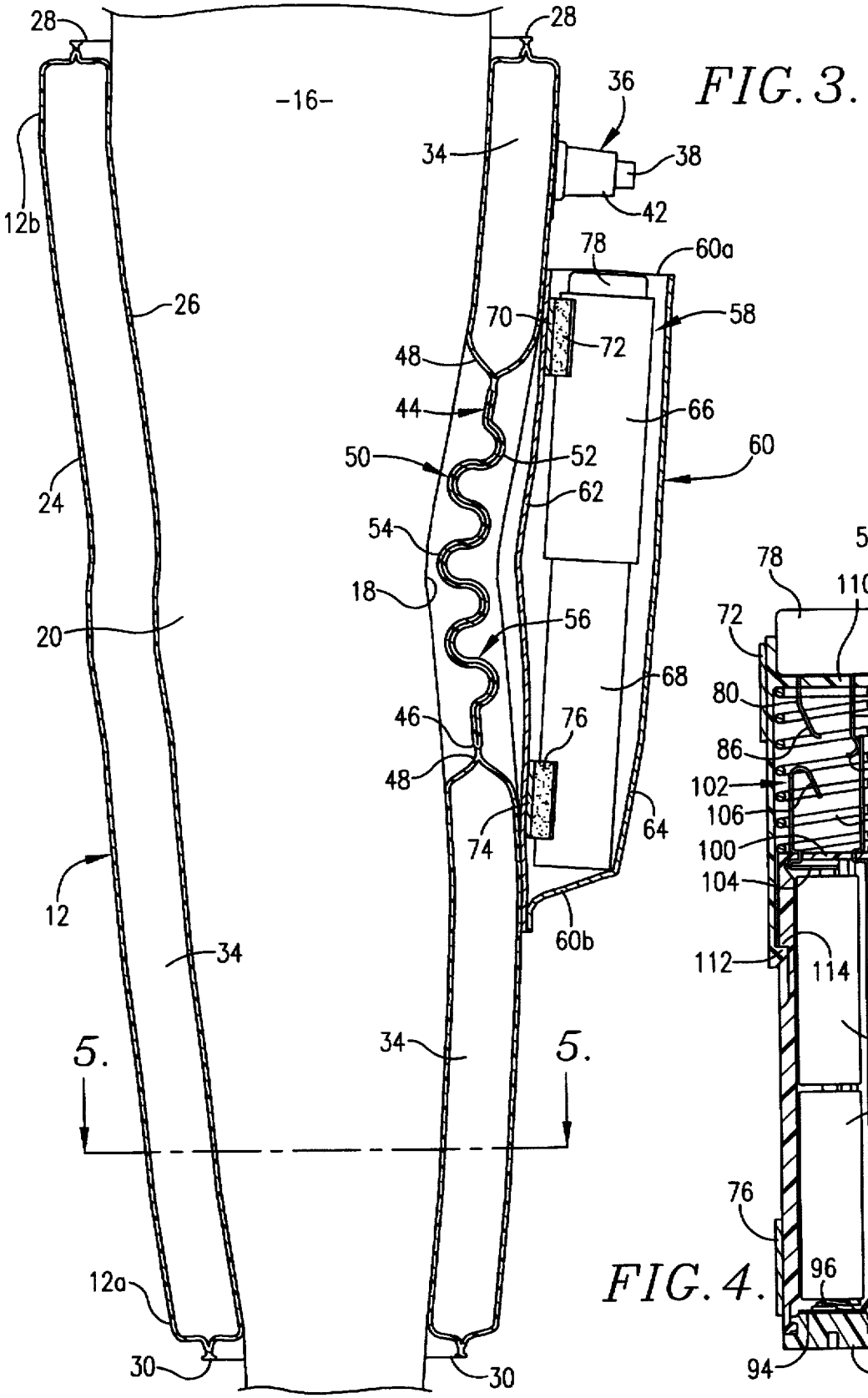
FIG. 3 is an enlarged cross-sectional view of the golf club swing teaching aid hereof as shown in FIG. 2, and with the golfer's arm being illustrated diagrammatically inside of the tubular sleeve of the aid.

A golf club swing teaching aid is broadly designated by the numeral 10 in the drawings and includes an elongated inflatable tubular sleeve 12. As depicted in FIG. 1, sleeve 12 is adapted to be worn by a golfer 14 on his or her leading arm 16 in generally surrounding and conforming relationship thereto and in a position such that the sleeve extends above and below the inner crease 18 of golfer's elbow 20 (FIG. 3). In the case of a right-handed golfer, the left arm is the weaker or leading arm during swinging of the golf club 22. The opposite is true for a left-handed golfer.

Figure 5:
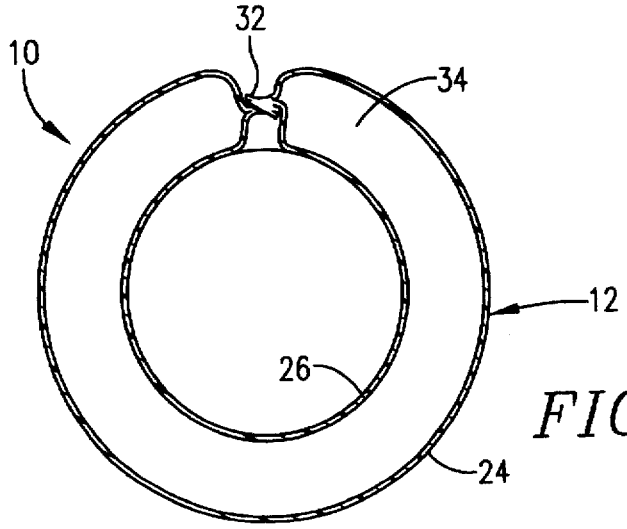
FIG. 5 is a horizontal cross-sectional view taken on the line 5—5 of FIG. 3 and looking in the direction of the arrows.

Inflatable tubular sleeve 12 is preferably formed of two initially rectangular wall-defining members 24 and 26 of flexible material which are joined along the upper edges 28 as well as along lower edges 30 (FIG. 3) and the longitudinally extending edges 32 (FIG. 5) which cooperate to define a cavity 34 therebetween. It is to be seen from FIG. 3 that the wall members 24 and 26 are made up of flexible panels that result in the tubular sleeve 12 formed therefrom being of smaller cross-sectional diameter at the lower end **12*a* than at the upper end 12*b*** of the sleeve.

A conventional air valve 36 is provided on the outer surface of wall member 24 and communicates with the cavity 34. Valve 36 may be of the type having a shiftable tubular valve element 38 that normally seals the interior of cavity 34 from ingress or egress of air but that may be pulled outwardly by the users of sleeve 12 to communicate the interior of cavity 34 with the surrounding atmosphere. In the case of aid 10 an auxiliary flexible plastic tube 40 (FIG. 2) is provided so that the golfer may place the tube over element 38 and pull the element out of the valve housing 42 so that he or she can blow air into sleeve 12 and inflate the latter to a predetermined extent. Return of the valve element 38 to its initial retracted position within housing 42 reseals cavity 34 against exit or entry of air.

Wall members 24 and 26 making up sleeve 12 are of dimensions such that when joined at edges 28, 30 and 32 to define the tubular sleeve 12, the sleeve extends a substantial part of the length of the golfer's arm 16 from a point above the wrist to a point just below the golfer's arm pit as is evident from FIG. 1. It is preferred that the sleeve be of a length such that it extends from a point one to two inches above the golfer's wrist pivot point to a level of at least no more than about four inches below the arm pit. It is contemplated that sleeves 12 of different lengths be made available for golfers of different heights.

Figure 2:
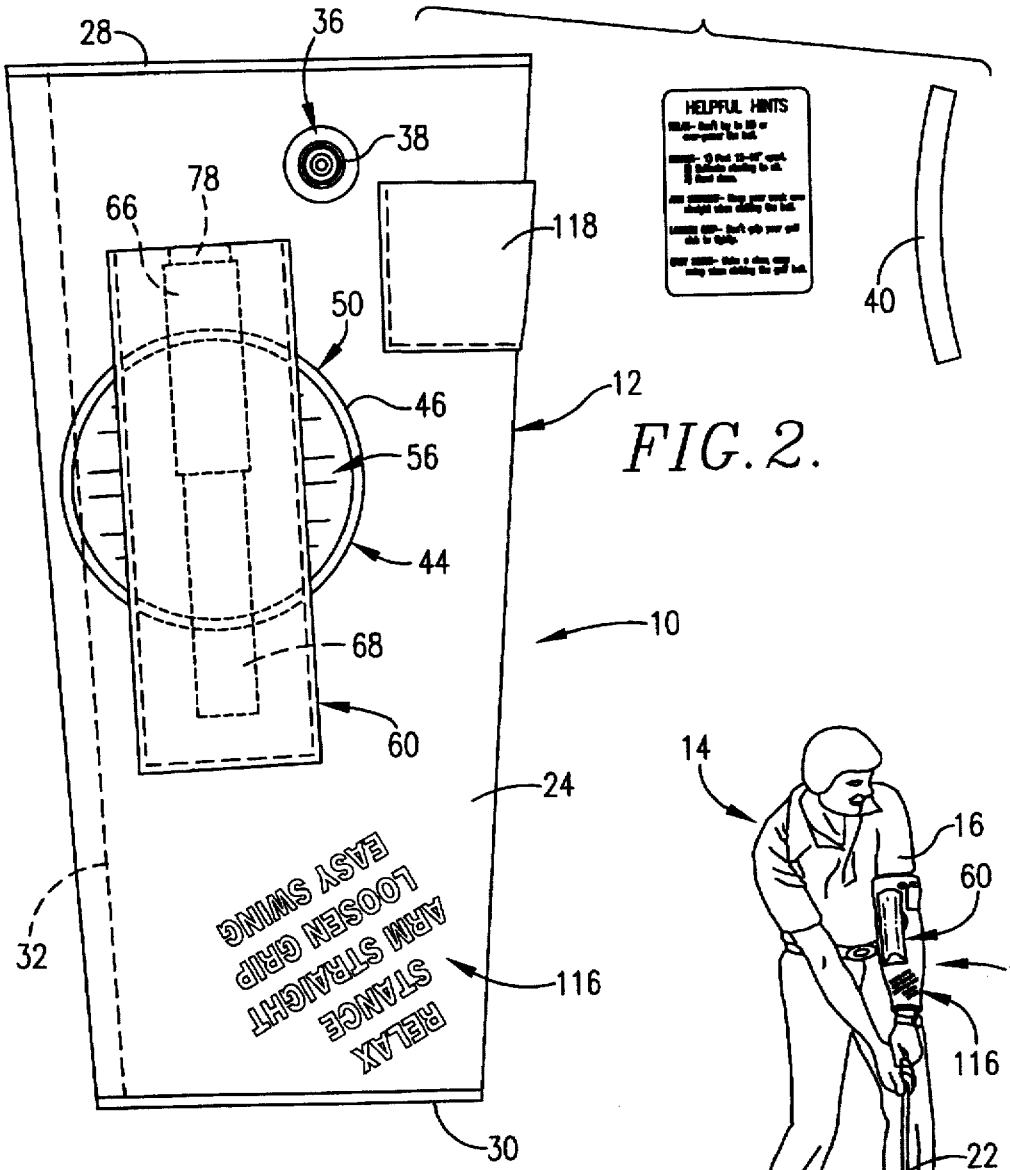
FIG. 2 is an elevational view of a golf club swing teaching aid constructed in accordance with the preferred concepts of the present invention and which includes an inflatable tubular sleeve and an alarm assembly mounted thereon, and also showing in exploded form a helpful hints card adapted to be carried within a pocket on the sleeve of the aid, along with a tube that is usable by the golfer to inflate the sleeve.

Sleeve 12 is optionally provided with a non-inflatable area broadly designated by the numeral 44 in FIGS. 2 and 3. The non-inflatable area is desirably of generally circular configuration and comprises a 3 or 4 inch diameter insert in a circular opening 46 through the normally forwardmost part of sleeve 12. It can be seen from FIG. 3 that circular opening 46 is defined by suitable joinder of adjacent, aligned circular margins 48 of wall members 24 and 26. A circular section 50 of flexible sleeve-defining material is integrally connected to the circular margins of wall members 24 and 26 presenting opening 46. Section 50 is desirably formed of two-ply material presenting alternate peaks 52 and valleys 54 which cooperate to present side-by-side parallel corrugations 56 which are oriented with the longitudinal lengths of peaks and valleys 52 and 54 respectively in generally perpendicular relationship to the elongated, longitudinal axis of sleeve 12 extending along the length thereof.

Although section 50 has been shown in FIG. 3 as being of separate material from wall members 24 and 26, it is to be appreciated that the corrugated section 56 may be made up of the same material as wall members 24 and 26 and thereby integral therewith, with the circle defining opening 46 being presented by the outer margin of the corrugated area 50. Furthermore, if desired, the corrugated section or area 50 may be omitted from sleeve 12 in certain applications thereof.

When the golfer dons sleeve 12, the corrugated flexible area 50 should be over the crease 18 of the golfer's arm 16 in disposition such that the upper and lower parts of margins 48 are equidistant from the center of the circular area 50.

An alarm assembly broadly designated 58 is adjustably mounted on sleeve 12 in overlying relationship to corrugated area 50, as shown in FIGS. 1 and 2, within an open-top, upright, rectangular pocket 60 that is secured to and also overlies the outermost face of wall member 24. Pocket 60 has a rear panel 62 secured to the outer surface of wall member 24 directly above the uppermost and lowermost margins 48 defining opening 46, as well as an outer panel 64 which is joined to rear panel 62 along the side margins of the latter, as well as along the bottom margin thereof.

Figure 4:
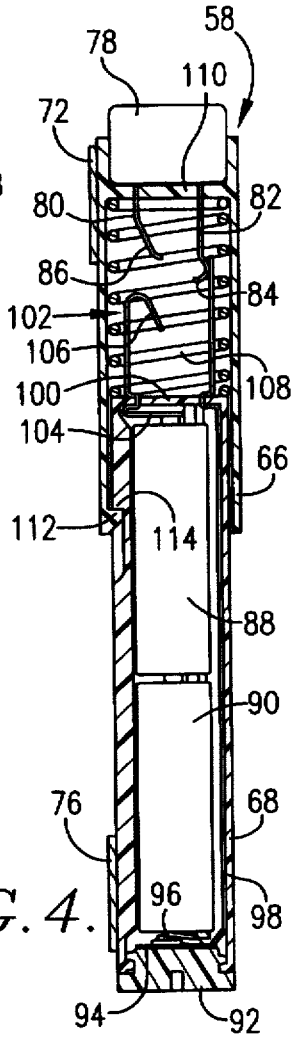
FIG. 4 is an enlarged vertically cross-sectional view through the alarm assembly of the present invention which is shown mounted in place on the tubular sleeve on the aid as shown in FIG. 3.

The alarm assembly includes a pair of tubular housing components 66 and 68 which are disposed in telescopic relationship as is most evident from FIG. 4. An elongated, upright strip 70 of Velcro fastening material is secured to the outer face of rear panel 62 adjacent the top **60*a* thereof midway between the side margins of pocket 60, while upright housing component 66 has an elongated strip 72 of Velcro fastening material thereon adapted to releasably engage Velcro strip 70. In like manner, an elongated strip 74 of Velcro fastening material is secured to the outer face of rear panel 62 in proximal relationship to the bottom 60*b* of pocket 60 and releasably connects with an elongated strip 76 of Velcro fastening material secured to the lower part of housing component 68. The Velcro fasteners thereby serve to releasably affix the alarm assembly 50 within pocket 60**.

Housing component 66 serves to mount an alarm signal device 78 which for example may be a piezo crystal actuated auditory alarm which emits an audible tone when a direct current is supplied to the device. A pair of contacts 80 and 82 are operably attached to and electrically connected to piezo device 78. It can be seen from FIG. 4 that contact 82 is desirably of greater length than contact 80. Furthermore, contact 82 has a curved contact end 84 while contact 80 is provided with an inclined contact segment 86 at the outer extremity of the same.

Lower housing component 68 serves to mount an electrical power supply which for example may take the form of two AA batteries 88 and 90. A removable plug 92 in the lower end of housing component 68 permits replacement of batteries 88 and 90 as required. A conductive element 94 carried by the inner surface of plug 92 normally engages spring means 96 which is interposed between the lowermost contact of the battery 90 and conductive element 94. An elongated conductor 98 extends along the length of housing component 68 from a point of engagement with conductive element 94 and into the interior of housing component 66 for engagement with contact end 84 of contact 82. The upper wall 100 of housing component 68 in normal closing relationship to the latter, serves to support a hook-shaped conductor 102 which extends upwardly into the interior of tubular housing component 66. The lowermost end of conductor 102 has an extension 104 thereon which is disposed to engage the upper terminal of battery 88. The hook portion 106 of conductor 102 is strategically located to complementally engage contact segment 86 of contact 80 when the housing components 66 and 68 move toward one another to a predetermined extent. Spring 108 within housing component 68 between the upper wall 110 thereof and wall 100 of housing component 68 serves to bias housing component 66 in a direction away from housing component 68. Interengageable shoulders 112 and 114 on housing component 66 and 68 respectively prevent relatively movement of the housing components in a direction away from one another beyond the positions thereof illustrated in FIG. 4.

Desirably, a series swing tips 116 to the golfer using sleeve 12 are printed, embossed or otherwise provided on the outer face of wall member 24 directly below pocket 60 and the area 50. Exemplary tips may for example be the terms "RELAX, STANCE, ARM STRAIGHT, LOOSEN GRIP, EASY SWING", which are in the order that the golfer should follow in preparing to swing club 22. It is also noteworthy that the words constituting swing tips for the golfer are at an angle such that the individual can readily read the text when he or she addresses the ball as depicted in FIG. 1.

Another open-top pocket 118 may if desired be placed on the outer surface of wall member 24 to the side of valve 36 adjacent the top of the sleeve for receipt of a "Helpful Hints" card containing further elaborations of the swing tips 116 that are provided on the lower part of the sleeve 12.

It is preferred that the inner wall member 26, or at least the innermost surface thereof, be constructed of a rubberized fabric which precludes the inner surface thereof from sticking or otherwise adhering to the skin of the golfer during donning or removal of the sleeve 12 from the golfer's arm, and particularly as a result of perspiration on the golfer's arm during hot weather use. The rubberized fabric may be in the form of an inner layer on wall member 26 or be an integral part and constitute the material from which inner wall member 26 is fabricated. Furthermore, the line of joinder 32 of wall members 24 and 26 extending longitudinally of sleeve 12 is preferably located on the backside of sleeve 12 in direct opposition to section 50 and alarm assembly 58.

In operation, the golfer places sleeve 12 while in an uninflated condition over his or her leading arm 16 in the position thereof as shown in FIG. 1 with the non-inflatable area 50 of sleeve 12 and associated alarm assembly 58 in directly overlying relationship to the crease 18 of the leading arm 16. It is to be understood in this respect that as the golfer introduces his or her leading arm into the uninflated sleeve 12, the sleeve should be turned on the leading arm to an extent that the tips 116 are readily observable by the golfer while in a ball address position, and the crease 18 of the golfer's arm is substantially in the middle of area 50, i.e., equidistantly spaced from the upper and lower margins 48 defining opening 46 of sleeve 12.

The golfer then uses plastic tube 40, which may for example be conveniently stored in pocket 118, to blow air into the cavity 34 of sleeve 12 through tubular valve 38 which has been pulled outwardly out of valve housing 42. It is noteworthy in this respect that the golfer may selectively control the amount of air which he or she blows into the interior of the inflatable sleeve 12. The amount of inflation of sleeve 12 controls to a certain extent the degree of bending of the golfer's leading arm that may take place at the elbow during backswing of the golf club 22.

If, during backswing of the golf club 22 by the golfer, he or she allows the leading arm 16 to bend at the elbow, such bending movement causes the housing components 66 and 68 to move toward one another against the bias of spring 108. If such relative movement toward one another of the housing components 66 and 68 is of such magnitude as to cause the hook portion 106 of conductor 102 to engage the contact segment 86 of contact 80, a circuit is completed between batteries 88 and alarm device 78 by virtue of the fact that contact end 84 of contact 82 remains in engagement with conductor 98 regardless of the relative positions of housing components 66 and 68 with respect to one another. Completion of the electrical circuit to piezo alarm device 78 causes an audible signal to be emitted which can readily be heard by the golfer. It can be seen in this respect that the golfer, as a result of hearing the alarm signal, may immediately restraighten his or her leading arm thereby allowing the housing components 66 and 68 to move away from each other under the influence of spring 108 thereby deactivating the alarm upon disengagement of contacts 80 and 102.

By virtue of the provision of Velcro fastening means for securing housing components 66 and 68 within pocket 60, the golfer may readily vary the extent of bending of his or her leading arm that may take place during backswing before an audible alarm is initiated. For example, viewing FIG. 3, if either or both of the Velcro strips 72 and 74 are repositioned on associated strips 70 and 74, the relative positions of housing components 66 and 68 may be varied. The greater the degree of telescoping of housing component 68 and housing component 66, and the closer the positions of contact 80 and conductor 102 are when the golfer's arm is in a straight condition, the lesser the degree of bending of the arm that is permitted before an audible alarm is sounded.

Thus, the golfer may selectively position housing components 66 and 68 in closer relationship than the fully extended locations thereof as depicted in FIG. 4 to cause the piezo alarm to be activated sooner than would otherwise be the case as a result of bending by the golfer of his or her leading arm. The golfer may want to start his or her practice with the housing components 66 and 68 in their outermost positions as shown in FIG. 4, either during first learning of the game, or even at the beginning of a practice session if he or she is a more experienced golfer, and then progressively move the housing components 66 and 68 toward one another so that the audible alarm is sounded with less and less bending of the leading arm occurring.

It is further of note that corrugated section 50 does not restrain desirable bending of the golfer's arm during follow-through that would otherwise occur if the sleeve was fully inflated throughout its cylindrical extent. The result is a more precise indication of bending of the golfer's leading arm during swinging of club 22 without undesirable impairment of arm bending during follow-through. It is to be recognized in this respect though that the extent of inflation of sleeve 12 also controls actuation of alarm assembly 58 in that the greater the degree of inflation, the more the golfer's arm is restrained against bending. Thus, the provision of corrugated section 50 and the fully adjustable mounting of alarm assembly 58 on sleeve 12 within pocket 60 permits the golfer to selectively adjust the compressive force of the sleeve on his leading arm in conjunction with selective adjustment of the relative positions of housing components 66 and 68. Each of these adjustments, i.e., the degree of inflation of sleeve 12, and the relative positioning of housing components 66 and 68 is infinite within the adjustment limits.

It is preferred that the housing components 66 and 68 be located such that when fully extended as shown in FIG. 4 and releaseably secured to the interior of pocket 60 as depicted in FIG. 3, that the piezo device 78 be activated to emit an audible tone when the golfer's leading arm has been allowed to bend during backswing through an arc of no more than about 20°. The housing components 66 and 68 may be provided with graduated indicia on the outer faces thereof which may be used by the golfer to selectively position the housing components in relative positions that are directly related to angular degrees of bending of the golfer's arm at which an audible sound is emitted by device 78. For example, the indicia may indicate degrees of arm bend from 0° to 20° in increments of no more than 5° with 10° to 15° being indicative of an intermediate level of play, and 0° to 10° reflecting a more advanced swing skill level. Thus, suitable markings may be provided in association with the audible alarm to indicate that an arm bend of no more than 20° is "good", no more than 10°–15° is "better", and no more than 5° is "best".

In lieu of tubular valve 38, a compressible pump bulb valve of conventional construction may be provided along with an air release valve communicating with the interior of the cavity 34. The bulb valve is of the type whereby the user can simply manually depress the bulb thereby forcing air from the atmosphere into cavity 34 via the inlet of the bulb valve. Upon release of the bulb the latter returns to its initial configuration and thereby pulls air into the interior thereof, which is then introduced into the interior of the sleeve cavity upon finger compression of the bulb. It is contemplated in this respect that the bulb may if desired be constructed to similar a golf ball and thereby have a series of small dimples in the spherical body of the bulb.

Similarly, the air release valve may alternately be provided on wall member 24 to permit air to be evacuated from cavity 34 may be of the bulb type which when manually compressed allows air to leak out of the sleeve cavity. In this instance, the sphere may also be configured to simulate a golf ball with small depressions therein, and may be of a different color than the compression bulb at the opposite end of sleeve 12. The compression bulb may be white in an exemplary embodiment of sleeve 12, while the air release valve bulb may be colored green.

In a further alternative embodiment of the invention, the piezo device 78 may be replaced with a micro-processor operated electronic device which emits a verbal message such as "your arm is bent", or any other desired message to alert the golfer the leading arm has been allowed to bend to an undesirable extent.

I claim:

1. A golf club swing teaching aid comprising:

an elongated tubular sleeve adapted to be worn by a golfer on his or her leading arm in generally surrounding and conforming relationship thereto and in selected disposition extending above and below the golfer's elbow; and an alarm assembly mounted on the sleeve for alerting the golfer that his or her leading arm has been allowed to bend to an undesirable extent during backswing of a golf club, said alarm assembly including first and second components, and means adjustably mounting the components on the sleeve in a location such that one of the components extends above the golfer's elbow when the sleeve is positioned on his or her leading arm in said selected disposition, and the second component extends below the golfer's elbow when the sleeve is in said selected disposition, said alarm assembly further including mechanism for emitting a signal discernable by the golfer that the first and second components have moved relative to one another to a predetermined extent during backswing of the club by a golfer indicative of bending of the golfer's arm at the elbow, said means adjustably mounting the components on said sleeve permitting selective adjustment by the golfer of the positions of the first and second components relative to one another to allow different selected degrees of bending of the leading arm by the golfer during backswing before the alarm signal is emitted.

2. A golf club swing teaching aid as set forth in claim 1 wherein said tubular sleeve is of flexible material and includes means permitting the golfer to selectively adjust the compressive force thereof on his or her arm in conjunction with selective adjustment of the relative positions of said first and second components.

3. A golf club swing teaching aid as set forth in claim 2 wherein the flexible sleeve is inflatable and includes at least two spaced wall members which cooperate to define a cavity therebetween, and means for permitting air to be introduced by the golfer into the cavity to inflate the sleeve while in said surrounding relationship to the golfer's arm.

4. A golf club swing teaching aid as set forth in claim 3 wherein said sleeve is provided with a non-inflatable area in disposition to be located adjacent the inner crease of the golfer's elbow, said first and second components being positioned in at least partial overlying relationship to said non-inflatable area to enhance the sensitivity of the alarm assembly.

5. A golf club swing teaching aid as set forth in claim 4 wherein said non-inflatable area includes a section of flexible sleeve-defining material having corrugations therein which present less resistance to bending of the golfer's elbow during swing follow-through than the remainder of the sleeve when it is positioned on the golfer's arm and has been inflated to a selected extent by a golfer.

6. A golf club swing teaching aid as set forth in claim 5 wherein said corrugations are defined by essentially parallel peaks and valleys which extend in generally transverse relationship to the longitudinal axis of the tubular sleeve.

7. A golf club swing teaching aid as set forth in claim 5 wherein said non-inflatable area is of generally circular configuration and of a diameter approximately equal to the inner arm receiving diameter of the tubular sleeve.

8. A golf club swing teaching aid as set forth in claim 1 wherein said means adjustably mounting the components on said sleeve includes structure allowing the first and second components to be selectively adjusted one with respect to the other within predetermined limits.

9. A golf club swing teaching aid as set forth in claim 8 wherein said structure includes Velcro fastening means on the first and second components, and on the sleeve respectively.

10. A golf club swing teaching aid as set forth in claim 9 wherein said Velcro fastening means includes a strip of Velcro on the first and second components, and a strip of Velcro on the sleeve for each of the Velcro strips on the first and second components, said Velcro strips each being located in disposition extending longitudinally of the tubular sleeve.

11. A golf club swing teaching aid as set forth in claim 1 wherein said first and second components each include a tubular element, with one of the elements being telescopically received within the other element, and said alarm assembly including means within the elements which is activated to emit said signal when one of the elements is shifted toward the other element to a predetermined extent as a result of bending of the golfer's arm at the elbow during backswing of the golf club.

12. A golf club swing teaching aid as set forth in claim 11 wherein said alarm assembly includes an electrically actuated alarm device, and switch components on said one and said other elements respectively which are brought in to contacting relationship to cause actuation of the alarm device when the elements shift toward one another to a predetermined extent as a result of bending of the golfer's elbow during backswing of the golf club.

13. A golf club swing teaching aid as set forth in claim 12 wherein provided biasing means normally maintaining the switch components in spaced relationship against the bias force thereon.

14. A golf club swing teaching aid as set forth in claim 12 wherein said alarm device includes a unit which emits an audible signal when the switch components are brought into contacting relationship.

15. A golf club swing teaching aid as set forth in claim 12 wherein said means adjustably mounting the components on said sleeve is operable to change the relative positions of the switch components with respect to one another in response to adjustment of the relative positions of the components one with respect to the other.

16. A golf club swing teaching aid as set forth in claim 1 wherein is provided informational lettering on the outer surface of the sleeve on the same side thereof as said components and in disposition presenting a series of tips to the golfer which are observable as he or she addresses a ball in preparation for striking of the ball.

17. A golf club swing teaching aid as set forth in claim 1 wherein said first and second components are positioned relatively such that the golfer must bend his or her elbow at the elbow crease to at least about 20° before the first and second components move relatively to an extent to effect actuation of said alarm assembly.

18. A golf club swing teaching aid as set forth in claim 1 wherein said first and second components are positioned relatively such that the golfer must bend his or her elbow at the elbow crease from about 5° to about 15° before the first and second components move relatively to an extent to effect actuation of said alarm assembly.

19. A golf club swing teaching aid as set forth in claim 1 wherein said first and second components are positioned relatively such that the golfer must bend his or her elbow at the elbow crease to about 10° before the first and second components move relatively to an extent to effect actuation of said alarm assembly.

* * * * *